US006969329B2

(12) United States Patent
Popovich

(10) Patent No.: US 6,969,329 B2
(45) Date of Patent: Nov. 29, 2005

(54) TABLE TENNIS PADDLE WITH TWO HANDLES

(75) Inventor: Victor Popovich, P.O. Box 310124, Newington, CT (US) 06131-0124

(73) Assignee: Victor Popovich, Newington, CT (US)

( * ) Notice: Subject to any disclaimer, the term of this patent is extended or adjusted under 35 U.S.C. 154(b) by 0 days.

(21) Appl. No.: 10/778,298

(22) Filed: Feb. 13, 2004

(65) Prior Publication Data

US 2005/0181895 A1 Aug. 18, 2005

(51) Int. Cl.[7] ..... A63B 59/04
(52) U.S. Cl. ..... 473/527
(58) Field of Search ..... 473/524, 527, 473/526, 549, 551, 552; D21/729, 731

(56) References Cited

U.S. PATENT DOCUMENTS

D164,883 S * 10/1951 Schmid ..... D21/731
D168,192 S * 11/1952 Schmid ..... D21/731
4,131,278 A * 12/1978 Goldenberg ..... 473/526
D255,137 S * 5/1980 Bowen ..... D21/732
D258,000 S * 1/1981 Greenwood ..... D21/729
5,312,101 A * 5/1994 McDaniel ..... 473/526
2003/0013564 A1 * 1/2003 McDaniel ..... 473/527

FOREIGN PATENT DOCUMENTS

FR 2611144 A1 * 4/1988
WO WO 93/00969 * 1/1993

* cited by examiner

*Primary Examiner*—Raleigh W. Chiu

(57) ABSTRACT

A novel paddle for use in racquet sports, and particularly table tennis. The paddle features two handles, that are designed to use a novel very secure grip with more relaxed hand to compare with conventional paddles and the blade of the paddle angled down and backwards with ability to produce very powerful forehand and backhand offence strokes.

2 Claims, 2 Drawing Sheets

TABLE TENNIS PADDLE WITH TWO HANDLES

FIELD OF THE INVENTION

This invention related to structures known as bats, racquets, paddles, or blades for use in ball games.

INTRODUCTION TO THE INVENTION

Consider that a table tennis racquet is a paddle equipped with sheets of rubber.

Table tennis is a very popular sporting event in which a racquet is used to hit table tennis balls. The effectiveness of hitting a ball depends on the grip of a table tennis racquet.

It is well-known that there are two major grips: handshake and penhold. Each of them has its well-known advantages and disadvantages.

The penhold's advantage: a forehand offensive topspin stroke is more effective with a penhold grip instead of the handshake grip. This is because a player using the penhold grip can hold the racquet with the blade angled down and backwards with a great extent before the stroke.

The penhold's disadvantage: the difficulty to execute backhand offensive strokes. Not many world-class players use the backhand side of their racquets for offensive strokes.

The handshake advantage: it allows to a player execute good backhand offensive strokes.

The handshake disadvantage: forehand strokes are not so effective to compare with the penhold grip.

There is a known penhold grip (hereinafter the "1+4 grip") where the thumb is positioned along the forehand side of a racquet and the other remaining fingers are positioned on the backhand side. This grip allows for good offensive strokes on the forehand and backhand sides but this grip also has its disadvantages The disadvantages of the 1+4 grip: the unsecure grip does not allow for fast hits or spin, and therefore it is not possible to produce strong attacks. The grip is also uncomfortable because the fingers on the backhand side of the racquet have nothing to hold.

From the above it is clear that a need exists for a racquet that has a handle(s) that allows for a novel, comfortable and secure grip with the blade down and backwards, for both forehand and backhand offensive strokes.

SUMMARY OF THE INVENTION

The present invention eliminates all of the above disadvantages. A two-handle paddle (the blade one and the side one) provides a player with a great secure grip similar to the 1+4 grip which combines the main advantages of the penhold and the handshake grips, without their respective disadvantages present, or other disadvantages arising. This novel grip has a very high surface of contact of the hand and paddle and increases the feel of the paddle. In addition, the handles are structured and positioned on the blade in allowing a player to have a comfortable wrist position with a more secure grip compared with conventional paddles and their ability to produce very powerful forehand and backhand strokes with a relaxed hand.

DESCRIPTION OF THE DRAWINGS

Rubber covers both striking sides of the blade 8 and the blade 8*b* (FIG. 8) but they are not shown. Both embodiments provide a secure grip for a right-handed player. The paddle for left-handed player would be a mirror image of FIG. 1, FIG. 2 and FIG. 8.

DESCRIPTION OF THE FIRST EMBODIMENT

Figure 1:
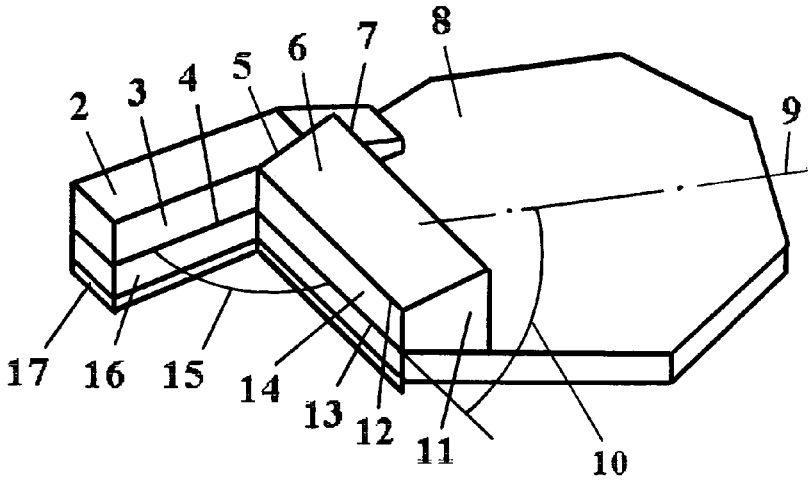
FIG. 1 shows a perspective view of the first embodiment of the inventive paddle.
Figure 2:
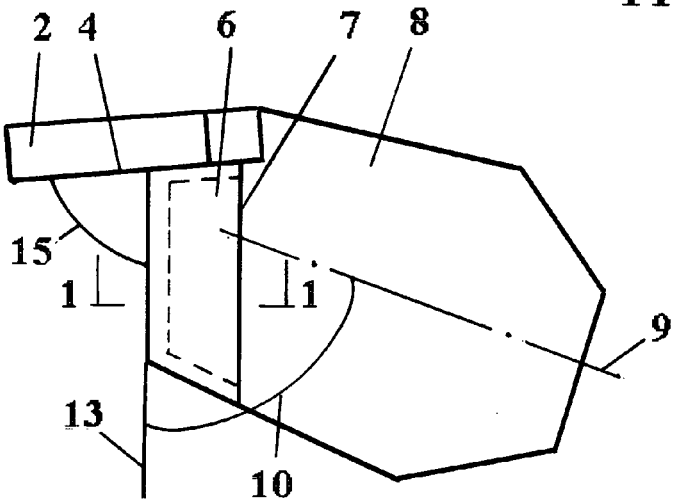
FIG. 2 shows a front view thereof.
Figure 4:
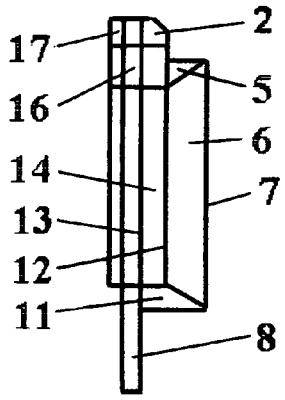
FIG. 4 shows a left side view thereof.
Figure 3:
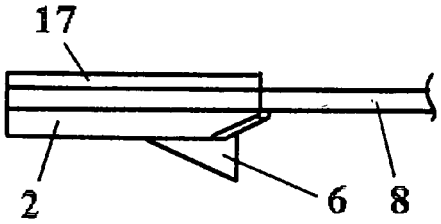
FIG. 3 shows a top plan view thereof.
Figure 5:
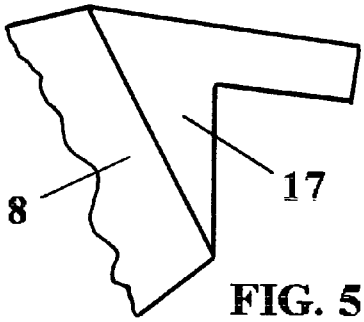
FIG. 5 shows a rear view thereof.
Figure 6:
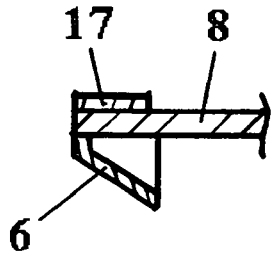
FIG. 6 shows a sectional view along the lines 1—1 of FIG. 2 thereof.
Figure 7:
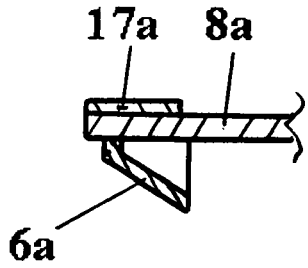
FIG. 7 shows a modification of sectional view along lines 1—1 of FIG. 2 thereof.

Hereinafter, if a figure is not mentioned, then the part is best shown on FIG. 1. The first embodiment on the figures from FIG. 1 to FIG. 7 shows that the paddle consists of five part: a blade 8, a side handle 6, a blade handle 16, a plate 2 and a cover 17. All of the parts could be made of wood, plywood, plastic or other materials that the game rules allow. They could be made as one piece or could be assembled using separate parts. These parts, for example, could be glued with the blade 8. The side handle 6 is fixed on the backhand side of the blade 8. An angle 10 between the midline 9 of the backhand side of the blade 8 and the intersection 13 of the left side 14 of the side handle 6 with the backhand side of the blade 6 is 68 degrees. The angle 10 could be in a range between 15 degrees and 160 degrees. The blade 8 is extended as the blade handle 16. A plate 2 is added to the backhand side of the blade handle 16. An angle 15 between the intersection 13 and a line 4 of the blade handle 16 is 80 degrees. The angle 15 could be in a range between 45 degrees and 150 degrees. The blade handle 16 has a cover 17 on its forehand side. The thickness of the cover 17 (FIG. 5) could be in a range between 0.2 mm and 25 mm but the best thickness is 4 mm. The plate 2, the blade handle 16 and the cover 17 look like the shaft of a conventional racquet and the sum of the thicknesses of these parts is 25 mm for the best grip by the thumb and the index finger. This thickness could be in a range between 7 mm and 80 mm. The cover 17 protects the surface of the forehand side of the blade handle 8. In a possible embodiment, there would be no cover 17. For good racquet feel while hitting a ball, there is a counterbalance of the blade with the rubber. The counterbalance consists of three parts: the blade handle 16, a part of the plate 2, and a part of the cover 17. FIG. 1 shows the side handle 6 that has the best configuration for the most secure grip that allows play with a semi-relaxed hand and wrist. The side handle 6 has four gripping parts: two walls 5 (FIG. 4) and 11 (FIG. 4), a left side 14, and a bridge that connected the walls with the left side 14. In this embodiment, the thumb holds the rubber on the forehand side of the blade 8 and the cover 17 (FIG. 5) and the index finger holds the plate 2 along the way such that the blade 8, the plate, and the cover 17 are above the hand. The index finger could contact the upper gripping wall 5 of the side handle 6. The middle finger, the ring finger and the little fingers are positioned inside a cavity created with the blade 8 (FIG. 6) and the gripping bridge of the side handle 6 (FIG. 6). The middle finger could contact with the gripping wall 5 and the little finger could contact both the gripping wall 11 and inside the side handle 6. Therfore, the thumb and the index finger hold the cover 17 and the plate 2 as one handle and the remaining fingers hold the side handle 6 as another handle. The angle 10 is less then 90 degrees and because of this the blade 8 is angled down and backwards.

This is very important for producing good forehand and backhand offensive strokes with the hand of the player in a comfortable position. The angle 15 is less then 90 degrees and that provides a player with a very secure grip of the side handle 6 and the blade handle 16. For a more secure grip, the side handle 6*a* (FIG. 7) could be positioned toward the blade handle 8*a*. The edge 7 of the side handle 6 is parallel to the edge 12. But, they do not have to be parallel. For example, because the middle finger is longer than the little finger, the upper edge of the gripping wall 5 could be made longer then the upper edge of the gripping wall 11. Also, the edge 7 does not have to be straight. It could be rounded along itself or it could have three rounded areas to accommodate the three fingers. In the first embodiment, the edge 12 of the side handle 6 is parallel to the blade 8. This allows a player to use both the forehand and the backhand sides of the paddle with equal effectiveness. But the edge 12 does not have to be parallel to the blade 8. If the gripping wall 11 is higher than the gripping wall 5, then the paddle (meaning that the hand of a player has the same position) is more open for forehand offensive strokes and more closed for backhand offensive strokes. In this case, this is better to produce backhand offensive strokes. And vice versa if the gripping wall 5 is higher than the wall 11.

The gripping bridge of the side handle 6 is not parallel to the blade 8 but it could be parallel or the edge 7 could be closer to the blade 8 then the edge 12. Edge 12, as well as line 13, does not have to be straight; one of them could be curved. The cross section of the side handle 6 (FIG. 6) does not eliminate other possible configurations of the side handle. The cross section of the side handle could be "I" formed as in the second embodiment or it could be "L" or "T" formed. Also, it could be any combination of the above-mentioned shapes. The different side handles could be perpendicular to the blade 8, as in the second embodiment, but instead of 90 degrees, there could be a different angle between the blade and the side handle. It is obvious that all the above modifications are in the scope of the present invention.

DESCRIPTION OF THE SECOND EMBODIMENT

Figure 8:
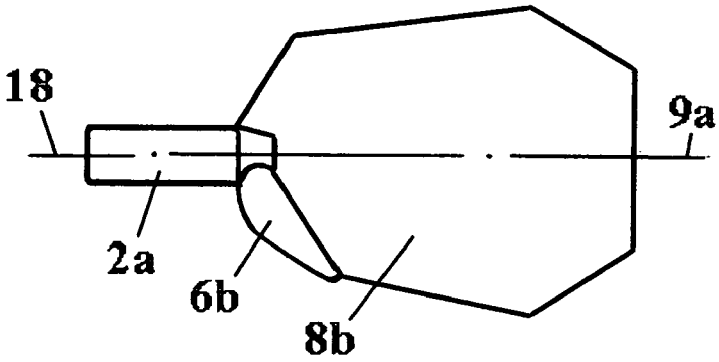
FIG. 8 shows a front view of the second embodiment of the inventive paddle.
Figure 9:
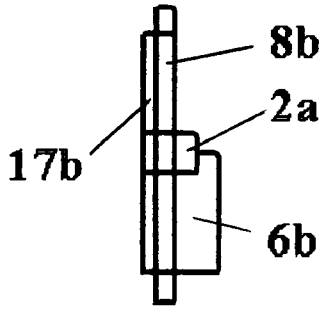
FIG. 9 shows a left side view of the second embodiment thereof.
Figure 10:
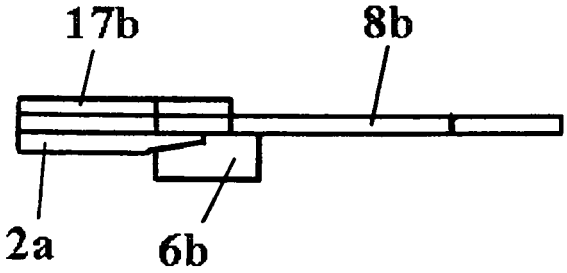
FIG. 10 shows a top plan view of the second embodiment thereof.

FIG. 8 to FIG. 10 show the second embodiment of the novel paddle. The midline of the blade handle 18 (FIG. 8) coincides with the midline 9*a* of the blade 8*b* (FIG. 8). The side handle 6*b* (FIG. 8) is made as one piece and its left side is rounded for a better fit with the hand. A grip for using the novel paddle according with the second embodiment is similar to the grip in the first embodiment.

With respect to the above description, it is to be realized that the optimum dimensional relationships for the parts of the invention, include variations in size, materials, shapes, form, assembly and grip, are deemed readily apparent and obvious to one skilled in the art, and all equivalent relationships to those illustrated in the drawings and described in the specification are intended to be encompassed by the present invention.

I claim:

1. A paddle for use in racquet sports, comprising:

a substantially flat blade (8) with forehand and backhand sides for hitting a ball;

a blade handle (16) extending from the blade;

a side handle (6) attached to the backhand side of the blade;

wherein the angle formed between the midline (9) of the blade and the left side of the side handle is between 5–160 degrees and an angle (14) formed between the blade handle and the side handle is between 45–150 degrees.

2. The paddle according to claim 1 further comprising a plate (2) attached to the backhand side of the blade handle (16).

* * * * *